US007941080B2

(12) United States Patent
Sakata et al.

(10) Patent No.: US 7,941,080 B2
(45) **Date of Patent: *May 10, 2011**

(54) IMAGE FORMING APPARATUS

(75) Inventors: Shoichi Sakata, Osaka (JP); Takahisa Nakaue, Osaka (JP); Kiyotaka Kobayashi, Osaka (JP); Yukihiro Mori, Osaka (JP)

(73) Assignee: Kyocera Mita Corporation (JP)

( * ) Notice: Subject to any disclaimer, the term of this patent is extended or adjusted under 35 U.S.C. 154(b) by 540 days.

This patent is subject to a terminal disclaimer.

(21) Appl. No.: 12/050,466

(22) Filed: Mar. 18, 2008

(65) Prior Publication Data

US 2008/0232860 A1 Sep. 25, 2008

(30) Foreign Application Priority Data

Mar. 20, 2007 (JP) ..... 2007-072784

(51) Int. Cl.
*G03G 15/06* (2006.01)
*G03G 15/09* (2006.01)
*G03G 13/09* (2006.01)

(52) U.S. Cl. ..... 399/270; 399/55; 399/271; 430/122.8

(58) Field of Classification Search ..... 399/55, 399/270, 271; 430/122.8
See application file for complete search history.

(56) References Cited

U.S. PATENT DOCUMENTS

| | | | | |
|---|---|---|---|---|
| 3,929,098 | A | 12/1975 | Liebman | |
| 5,003,351 | A * | 3/1991 | Waki et al. | 399/231 |
| 6,668,146 | B2 * | 12/2003 | Folkins et al. | 399/266 |
| 7,308,222 | B2 * | 12/2007 | Nakagawa et al. | 399/265 |
| 7,580,659 | B2 * | 8/2009 | Miyabe et al. | 399/285 |
| 7,742,727 | B2 * | 6/2010 | Sakata et al. | 399/270 |
| 7,761,041 | B2 * | 7/2010 | Maeyama et al. | 399/281 |
| 2004/0022549 | A1 * | 2/2004 | Ozawa et al. | 399/55 |
| 2004/0131394 | A1 | 7/2004 | Katoh et al. | |
| 2006/0062606 | A1 * | 3/2006 | Okada | 399/285 |
| 2009/0003855 | A1 * | 1/2009 | Kubo | 399/44 |

FOREIGN PATENT DOCUMENTS

| | | |
|---|---|---|
| CN | 1523457 | 12/2004 |
| JP | 2001-134050 | 5/2001 |
| JP | 2003-21961 | 1/2003 |
| JP | 2003-21966 | 1/2003 |
| JP | 2003-280357 | 10/2003 |
| JP | 2005-242281 | 9/2005 |

* cited by examiner

*Primary Examiner* — David M Gray
*Assistant Examiner* — Francis Gray
(74) *Attorney, Agent, or Firm* — Gerald E. Hespos; Michael J. Porco

(57) ABSTRACT

An image forming apparatus is provided with a photoconductive member on which a latent image is to be formed, a developing roller for developing the latent image formed on the photoconductive member by a first bias, and a magnetic roller for forming a magnetic brush thereon with a two-component developer and forming a thin toner layer on the developing roller by a second bias. If (D1) denotes the duty ratio of a first alternating-current bias included in the first bias and (D2) denotes the duty ratio of a second alternating-current bias included in the second bias, the duty ratios (D1, D2) satisfy the following relationship:

$D1>100-D2.$

14 Claims, 7 Drawing Sheets

IMAGE FORMING APPARATUS

BACKGROUND OF THE INVENTION

1. Field of the Invention

The present invention relates to an electrophotographic image forming apparatus using a two-component developer containing a magnetic carrier and a nonmagnetic toner.

2. Description of the Related Art

A two-component developing method using a toner and a carrier and a one-component developing method using no carrier are known as developing methods in image forming apparatuses. The two-component developing method has advantages of having a good chargeability of the toner by the carrier and a longer operating life, whereas it has disadvantages of making a developing device large and complicated and varying image quality depending on the durability of the carrier. Further, the one-component developing method has advantages of making the developing device compact and having a good dot reproducibility, whereas it has disadvantages of generally making a developing roller and a supply roller less durable and making a consumable cost more expensive due to the exchange of developing devices on a regular basis. Further, the supply of the toner having such a charging property as to be developed on the developing roller is not suitable for high-speed processing apparatuses, which has presented a problem to the speed-up of the image formation.

There has been known a so-called touch-down developing method taking advantages of characteristics of the above both developing methods. The touch-down developing method uses a two-component developer containing a toner and a carrier, forms a toner layer on a developing roller with a magnetic brush having the sufficiently charged toner, and develops an electrostatic latent image formed on a photoconductive member in a non-contact manner with the toner held on the developing roller.

The touch-down developing method is a developing method capable of high-speed image formation and is applicable to a developing device of a one-drum color superimposing type in which a plurality of color images are successively formed on a photoconductive member; of a tandem type in which a plurality of electrophotographic processing members are arranged side by side and color images are formed and superimposed on a transfer material (sheet) in synchronism with the conveyance of the transfer material; of a tandem type in which a plurality of electrophotographic processing members are arranged side by side along an intermediate transfer member (transfer belt) and color images are superimposed on the intermediate transfer member; and of other types.

In the case of tandem image forming apparatuses, a plurality of electrophotographic processing members is arranged side by side. Thus, if developing rollers and magnetic rollers are transversely arranged with respect to photoconductive members, the electrophotographic processing members themselves have a large width, which hinders the miniaturization. Therefore, miniaturized image forming apparatuses have been proposed in which the developing rollers and the magnetic rollers as the electrophotographic processing members are arranged above or below the photoconductive members to make the developing devices vertically long.

As a prior art on such a technology, U.S. Pat. No. 3,929,098 (lines 10 to 43, second column) discloses a developing device in which a developer is caused to head for a donor roller (developing roller) using a magnetic roller to transfer a toner onto the donor roller, thereby forming a thin toner layer.

However, according to this method, a toner charge control is complicated and it is necessary to apply a high surface potential and a large developing electric field to a photoconductive member. Further, it is difficult to refresh the toner on the donor roller, which was not used for development, and a toner adhering state and a potential difference of the toner on the donor roller vary if a toner consumed region and a toner non-consumed region are present on the donor roller. Such variations are likely to cause a phenomenon in which a part of a previously developed image appears as a ghost image during the next development, i.e. a so-called history phenomenon.

In order to solve this problem, Japanese Unexamined Patent Publications Nos. 2003-21961 and 2003-21966 disclose developing devices each comprising a magnetic roller in which a magnetic member for holding the magnetic brush formed of a two-component developer containing a carrier and a toner is fixed; a developing roller for forming a thin toner layer by the abrasive contact with the magnetic brush held by the magnetic roller; and a power supply for forming an alternating-current bias between the developing roller and a photoconductive member. In each of these developing devices, a latent image on the photoconductive member is developed with the toner caused to fly from the thin toner layer formed on the developing roller by the alternating-current bias, thereby preventing an occurrence of ghost at the time of development while avoiding an occurrence of an image fog. However, according to this method, a highly accurate control is required to balance the alternating-current bias formed between the developing roller and the photoconductive member and direct-current biases applied to the developing roller and the magnetic roller.

Further, Japanese Unexamined Patent Publication No. 2003-280357 discloses a developing device comprising a magnetic roller and a developing roller similar to the above and adapted to apply an alternating-current bias superimposed with a direct-current bias to the developing roller. Here, by setting a duty ratio of the alternating-current bias to 10 to 50%, the toner attraction (collection) from the developing roller to the magnetic roller is increased to solve the contamination of the developing roller with the toner. However, in the developing device of this type as well, a highly accurate control is required to balance the alternating-current bias applied to the developing roller and direct-current biases applied to the developing roller and the magnetic roller. Therefore, there has been a demand for technology requiring less control accuracy.

Japanese Unexamined Patent Publication No. 2001-134050 discloses a developing device using a one-component developer, comprising a developing roller held in contact with a photoconductive member and a supply roller held in contact with the developing roller, and constructed such that a toner is supplied to the developing roller by the supply roller and develops a latent image on the photoconductive member while being frictionally charged by a restricting blade on the developing roller to form a thin layer. In this device, an alternating-current voltage is applied to the developing roller, thereby preventing a problem that it is difficult to develop low-density images and thin line images and a problem that density nonuniformity occurs due to an increase in a toner charge amount and making it easier to scrape off (collect) the toner not having been used for development. However, an image fog occurs if the alternating-current voltage applied to the developing roller for forming a developing electric field is increased, whereas the effect of scraping off the toner not having been used for development is reduced if the alternating-current voltage is decreased. It is disclosed to apply an alternating-current voltage also to the supply roller and let the two alternating-current voltages have the same frequency, but different phases in order to solve this problem. However, the developing device is of the type using the one-component developer and constructed such that the photoconductive member and the supply roller are in contact with the developing roller and, if the developing devices of such a type in which the photoconductive member and the developing roller are in contact are used in a tandem image forming apparatus, a torque variation of a transfer belt might be caused to promote a color drift as a weak point of the tandem image forming apparatus.

In view of the above, Japanese Unexamined Patent Publication No. 2005-242281 discloses a developing device including a magnetic roller in which a magnetic pole member holding a magnetic brush is fixed, a developing roller to be rubbed by the magnetic brush held in the magnetic roller for the formation of a thin toner layer, a power supply for applying an alternating-current bias to the developing roller and another power supply for applying an alternating-current bias, which is a rectangular wave having the same frequency as, an opposite phase to and an inverted duty ratio of the above alternating-current bias, to the magnetic roller. This device makes it easier to form the thin toner layer on the developing roller and to collect the toner from the developing roller by increasing a potential difference between the alternating-current bias of the developing roller and that of the magnetic roller. This developing device balances the respective biases formed between the developing roller and a photoconductive member and between the developing roller and the magnetic roller so that image developability can be maintained without changing the potential difference between the photoconductive member and the developing roller at all even if it should be used in a tandem image forming apparatus.

However, in order to cope with faster printing, miniaturization and even higher image quality in image forming apparatuses of recent years, it is asked for to rotate the photoconductive member at a higher speed, to make the diameter of the photoconductive member smaller and to make toner particles smaller. If time required to pass a developing area is shortened due to the smaller diameter and faster rotation of the photoconductive member and the smaller diameter of the developing roller, it is necessary to increase a developing electric field or reduce toner adherence to the developing roller in order to improve the developability on the photoconductive member. Further, if time required to pass a toner layer forming area is shortened due to the smaller diameter and faster rotation of the developing roller and the smaller diameter of the magnetic roller, it is necessary to reduce the toner adherence to the developing roller while intensifying the electric field for collecting the toner from the developing roller. If the toner particles are made smaller, it is necessary to generate a strong electric field between the photoconductive member and the developing roller to increase a force for causing the toner to fly from the developing roller to the photoconductive member while suppressing an increase of the toner adherence to the developing roller surface and also to intensify the electric filed between the developing roller and the magnetic roller for collecting the toner from the developing roller to the magnetic roller.

However, since the biases applied to the developing roller and the magnetic roller become a composite bias between the developing roller and the magnetic roller, the bias applicable to suppress a discharge while maintaining the developability and collectability is restricted in its phase, cycle and waveform, which has hindered the miniaturization and the higher speed. Specifically, the toner on the developing roller comes into contact with the magnetic brush many times according to the rotation of the developing roller even after being supplied to the developing roller by the magnetic brush, and is exposed to the electric field applied between the magnetic brush and the developing roller each time. Thus, if the electric field acting in a direction to supply the toner toward the developing roller is increased for the higher speed or the like, the toner is likely to firmly adhere to the developing roller. This, for example, hinders the toner supply from the developing roller to the photoconductive member and makes it difficult to collect the toner from the developing roller to the magnetic roller. As a result, a range in which the bias formed between the developing roller and the photoconductive member and the one formed between the developing roller and the magnetic roller are balanced becomes even narrower.

With the technologies of the patent literatures described above, it has been difficult to balance the bias formed between the developing roller and the photoconductive member and the one formed between the developing roller and the magnetic roller to improve the developability on the photoconductive member while coping with the formation of the thin toner layer on the developing roller and the collection of the toner from the developing roller in the development process asking for the faster rotation and the smaller diameter of the photoconductive member and the smaller toner particles. If an attempt is made to cope with the formation of the thin toner layer on the developing roller and the toner collection from the developing roller, the developability on the photoconductive member is reduced. There has been also a problem that the image nonuniformity of low tone images occurs due to the deterioration of the developer and the variation of the nip width between the developing roller and the photoconductive member caused by the repeated phenomenon.

SUMMARY OF THE INVENTION

An object of the present invention is to enable an easy balance between a bias formed between a developing roller and a photoconductive member and the one formed between the developing roller and a magnetic roller. Another object is to satisfactorily form a thin toner layer on the developing roller and collect the toner from the developing roller, to improve developability on the photoconductive member and to suppress image defects such as the image nonuniformity of low tone images.

One aspect of the present invention accomplishing the above objects is directed to an image forming apparatus, comprising a photoconductive member on which a latent image is to be formed; a developing roller for developing the latent image formed on the photoconductive member by a first bias; a magnetic roller for forming a magnetic brush thereon with a two-component developer containing a carrier and a toner and forming a thin toner layer on the developing roller by a second bias; and a bias applying device for applying biases to the developing roller and the magnetic roller. The first bias includes a first alternating-current bias in the form of a rectangular wave, and the second bias includes a second alternating-current bias in the form of a rectangular wave. If D1 denotes the duty ratio of the first alternating-current bias and D2 denotes the duty ratio of the second alternating-current bias, the duty ratios D1, D2 satisfy the following relationship when the duty ratio D1 is calculated using an application period of a voltage in a direction to transfer the toner from the developing roller toward the photoconductive member as a positive period and the duty ratio D2 is calculated using an application period of a voltage in a direction to transfer the toner from the magnetic roller toward the developing roller as a positive period:

$$D1>100-D2.$$

In an image forming apparatus according to another aspect of the present invention, if f1 denotes the frequency of the first alternating-current bias and f2 denotes the frequency of the second alternating-current bias, the frequencies f1, f2 satisfy the following relationship:

$$f2>f1.$$

In an image forming apparatus according to still another aspect of the present invention, the bias applying device includes first and second power supplies for generating biases; a bias of the first power supply is applied as the first bias to the developing roller; and a superimposed bias of the bias of the first power supply and that of the second power supply is applied as the second bias to the magnetic roller.

These and other objects, features, aspects and advantages of the present invention will become more apparent upon a reading of the following detailed description and accompanying drawings.

DETAILED DESCRIPTION OF THE PREFERRED EMBODIMENTS

One embodiment of the present invention is described below with reference to the accompanying drawings, but the present invention is not limited to this embodiment. The embodiment of the present invention is a most preferable mode of the invention and the application thereof and terms and the like used here are not limited thereto.

Figure 1:
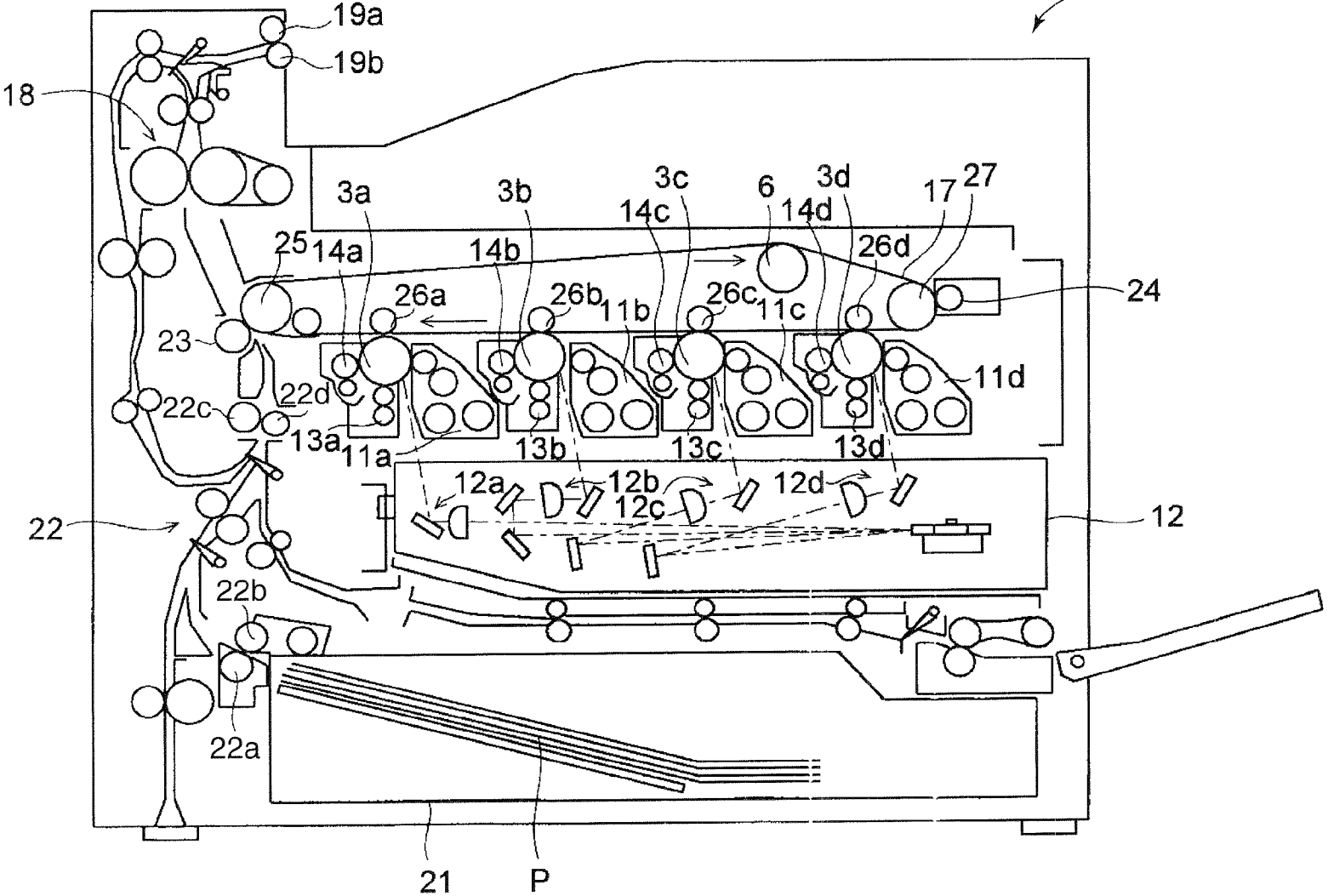
FIG. 1 is a schematic diagram showing the entire construction of an image forming apparatus according to one embodiment of the invention.

FIG. 1 is a schematic diagram showing the entire construction of an image forming apparatus 20 according to one embodiment of the present invention. The image forming apparatus 20 includes rotatable photoconductive members 3*a* to 3*d* provided in correspondence with the respective colors of black (B), yellow (Y), cyan (C) and magenta (M). An amorphous silicon photoconductor or an organic photoconductor (OPC) is, for example, used as a photoconductive material for forming photoconductive layers of the photoconductive members 3*a* to 3*d*.

A developing device 11*a* to 11*d*, an optical exposure device 12*a* to 12*d*, a charger 13*a* to 13*d* and a cleaning device 14*a* to 14*d* are arranged around each photoconductive member 3*a* to 3*d*. Each developing device 11*a* to 11*d* includes a developing roller and a container for a toner of the corresponding color. An exposure unit 12 irradiates the photoconductive members 3*a* to 3*d* with laser beams from the optical exposure devices 12*a* to 12*d* based on a document image data inputted to an image input unit (not shown) from a personal computer or the like.

The image forming apparatus 20 further includes an intermediate transfer belt 17, primary transfer rollers 26*a* to 26*d*, a secondary transfer roller 23 and a cleaning roller 24. The intermediate transfer belt 17 is mounted on a tension roller 6, a drive roller 25 and a driven roller 27. The respective photoconductive members 3*a* to 3*d* are so arranged adjacent to each other from an upstream side along a conveying direction (direction of an arrow in FIG. 1) of the intermediate transfer belt 17 as to touch the intermediate transfer belt 17. The respective primary transfer rollers 26*a* to 26*d* are arranged to face the corresponding photoconductive members 3*a* to 3*d* with the intermediate transfer belt 17 located therebetween and to touch the intermediate transfer belt 17. The secondary transfer roller 23 is so arranged as to face the drive roller 25 with the intermediate transfer belt 17 located therebetween and to touch the intermediate transfer belt 17. The cleaning roller 24 is so arranged as to face the driven roller 27 with the intermediate transfer belt 17 located therebetween and to touch the intermediate transfer belt 17.

The intermediate transfer belt 17 is comprised of an elastic belt as a base member, a fluorine resin layer provided on the outer surface of the elastic belt and a reinforcing resin layer provided on a side of the elastic belt opposite to the fluorine resin layer. The reinforcing resin layer effectively prevents a transfer displacement caused by the expansion and contraction of the elastic belt. The intermediate transfer belt 17 may have a resin film single layer structure without being restricted to the above structure. The primary transfer rollers 26*a* to 26*d* and the secondary transfer roller 23 can be formed of an electrically conductive rubber such as foamed EPDM (ethylene propylene diene monomer). Instead of the cleaning roller 24, a cleaning blade, a cleaning brush or the like may be used.

When an image forming operation is started, the respective photoconductive members 3*a* to 3*d* are rotated counterclockwise in FIG. 1, the respective chargers 13*a* to 13*d* uniformly charge the surfaces of the corresponding photoconductive members 3*a* to 3*d*, and the respective optical exposure devices 12*a* to 12*d* irradiate the surfaces of the corresponding photoconductive members 3*a* to 3*d* with lights based on an image data to form electrostatic latent images on the surfaces of the photoconductive members 3*a* to 3*d*. Subsequently, toners of the respective colors are caused to adhere to the electrostatic latent images formed on the surfaces of the photoconductive members 3*a* to 3*d* by development bias voltages applied to the developing rollers of the respective developing devices 11*a* to 11*d*, thereby forming toner images.

The toner images of the respective colors formed on the surfaces of the photoconductive members 3*a* to 3*d* are successively primarily transferred to the intermediate transfer belt 17 conveyed in the direction of arrow in FIG. 1 to be superimposed by the primary transfer rollers 26*a* to 26*d*, to which primary transfer bias potentials (having a polarity opposite to a toner charge polarity) are applied, whereby a full color toner image is formed on the intermediate transfer belt 17.

The image forming apparatus 20 is further provided with a sheet conveying assembly 22 for conveying a sheet P and a fixing device 18 for fixing the toner image to the sheet P. The sheet conveying assembly 22 dispenses sheets P stacked in a sheet cassette 22 one by one, and conveyance rollers 22*a*, 22*b* and registration rollers 22*c*, 22*d* convey the sheet P to between the intermediate transfer belt 17 and the secondary transfer roller 23. The full color toner image formed on the intermediate transfer belt 17 is secondarily transferred to the sheet P by the secondary transfer roller 23 having a secondary transfer bias potential (having a polarity opposite to the toner charge polarity) applied thereto.

The sheet P having the full color toner image transferred thereto is conveyed to the fixing device 18 and is heated and pressed by a fixing roller to have the toner image fixed to the surface thereof, thereby forming a full color image. The sheet P having the full color image formed thereon is, thereafter, discharged to the outside of an apparatus main body by discharge rollers 19*a*, 19*b*.

The toners remaining on the respective photoconductive members 3*a* to 3*d* without being primarily transferred from the photoconductive members 3*a* to 3*d* to the intermediate transfer belt 17 are removed by the cleaning devices 14*a* to 14*d*. Thereafter, electric charges remaining on the surfaces of the photoconductive members 3*a* to 3*d* are neutralized by unillustrated charge neutralizers. The toner remaining on the intermediate transfer belt 17 without being secondarily transferred to the sheet P is removed by the cleaning roller 24 having a cleaning bias potential (having a polarity opposite to the toner charge polarity) applied thereto, whereby preparation for the next image formation is made.

Figure 2:
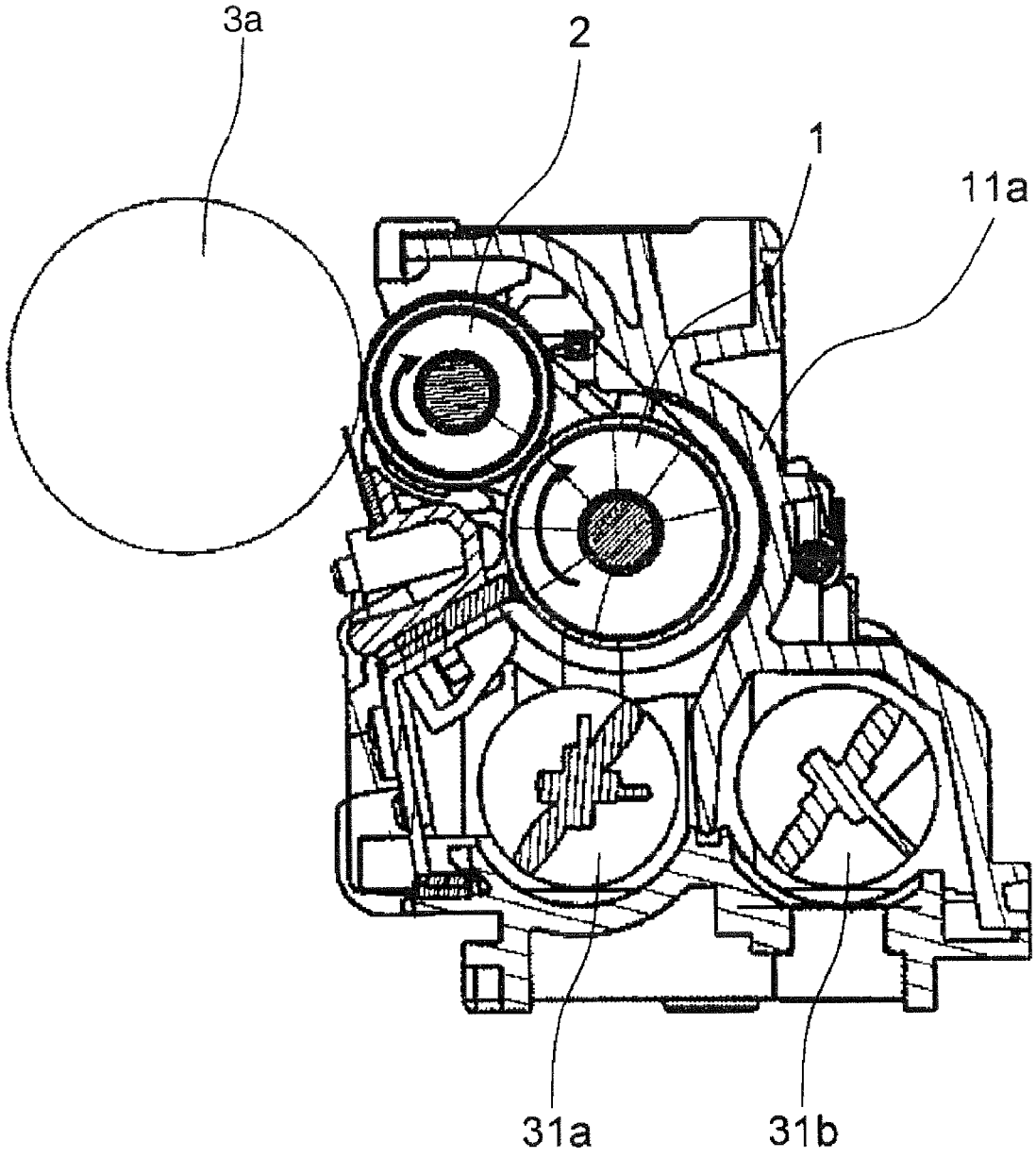
FIG. 2 is a side view in section showing the construction 6 of a developing device used in the image forming apparatus.

FIG. 2 is a side view in section showing the construction of the developing device 11*a*. The construction and operation of the developing device 11*a* facing the photoconductive member 3*a* of FIG. 1 are described below. The constructions and operations of the developing devices 11*b* to 11*d* are similar and are not described.

The developing device 11*a* includes a magnetic roller 1, a developing roller 2, a first agitating screw 31*a* and a second agitating screw 31*b*. The developing device 11*a* is for supplying a two-component developer containing a toner and a carrier to the photoconductive member 3*a*.

The first and second agitating screws 31*a*, 31*b* mix and agitate the toner supplied from an unillustrated toner container with the carrier to charge the toner and the carrier. A magnetic brush is formed on the magnetic roller 1 with the developer containing the charged toner and carrier. The magnetic brush is held in contact with the developing roller 2 with a specified layer thickness, and a thin toner layer is formed on the developing roller 2 by a bias given between the magnetic roller 1 and the developing roller 2. By a bias given between the developing roller 2 and the photoconductive member 3, the toner flies from the thin toner layer on the developing roller 2 to the photoconductive member 3, whereby the transferred toner adheres to an electrostatic latent image formed on the surface of the photoconductive member 3 to form a toner image. Here, the bias given between the developing roller 2 and the photoconductive member 3 is called a first bias and the one given between the developing roller 2 and the magnetic roller 1 is called a second bias.

Figure 3:
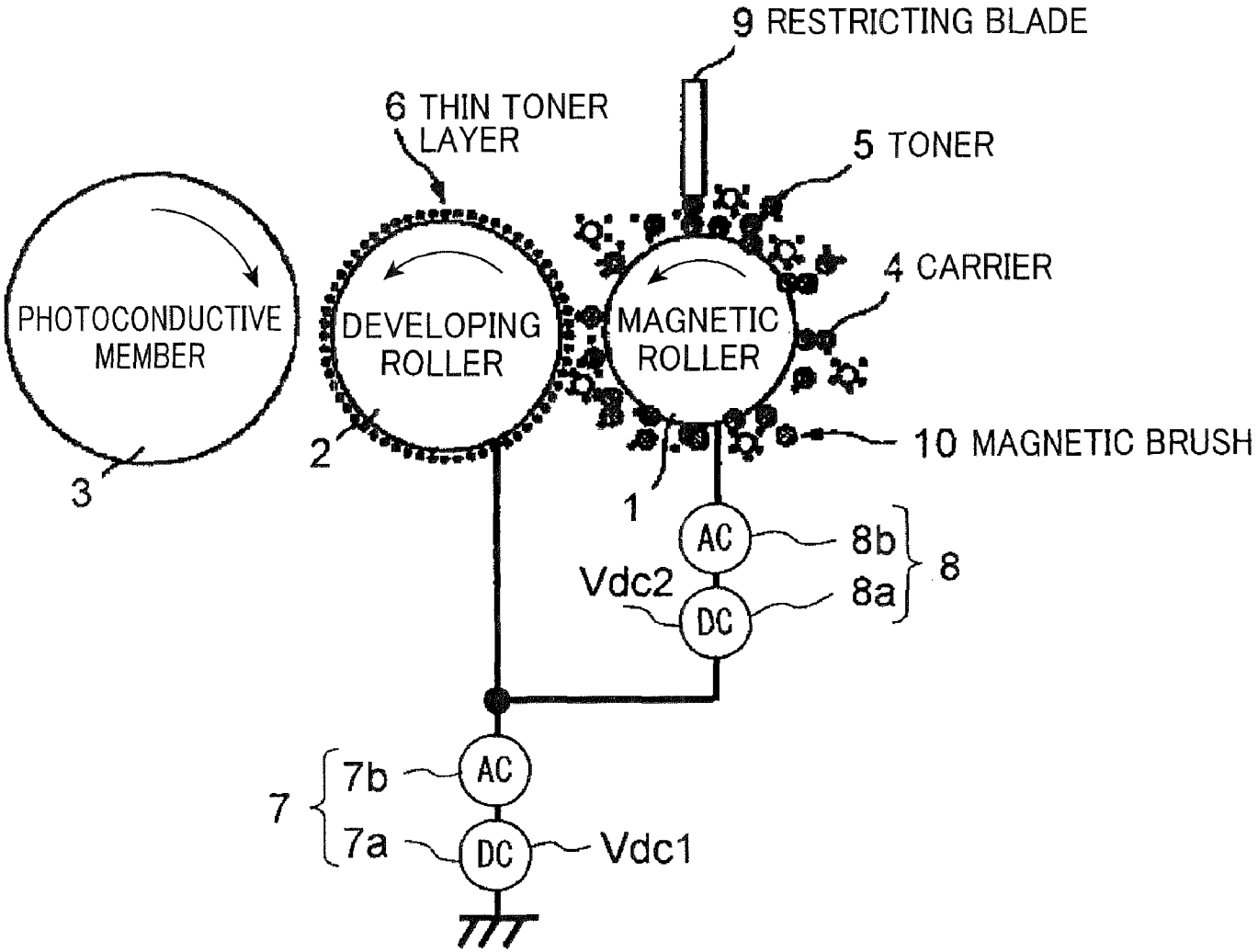
FIG. 3 is a schematic diagram of the developing device.

Next, the developing device 11*a* is described in more detail with reference to the diagram of the developing device of FIG. 3. In addition to the magnetic roller 1, the developing roller 2 and the photoconductive member 3, here are shown a carrier 4 and a toner 5 (developer layer) carried on the magnetic roller 1, a restricting blade 9 for restricting a developer layer thickness on the magnetic roller 1, a magnetic brush 10 formed on the magnetic roller 1, a thin toner layer 6 on the developing roller 2, a first power supply 7 and a second power supply 8. As shown in FIG. 3, the magnetic roller 1 is rotated counterclockwise, the developing roller 2 is rotated counterclockwise and the photoconductive drum 3 is rotated clockwise.

As described above, a drum made of an amorphous silicon (a-Si) photoconductor or an organic photoconductor (OPC) can be used as the photoconductive member 3. In the case of using the a-Si photoconductor as the photoconductive material of the photoconductive member 3, there is a characteristic that surface potential after the exposure is at a very low level of 20 V or less. If the film is thinned, saturation charge potential decreases, thereby reducing a withstand voltage to cause a dielectric breakdown. On the other hand, charge density on the surface of the photoconductive member 3 when a latent image is formed and developability tend to be improved. This property is particularly eminent in the case where the film thickness is 25 μm or smaller, more preferably 20 μm or smaller with an a-Si photoconductor having a high dielectric constant of about 10.

In the case of using a positively charged organic photoconductor (OPC) for the photoconductive member 3, the positively charged organic photoconductor (OPC) is stably charged by having a little generation of ozone and the like. Particularly, the positively charged organic photoconductor having a single layer structure has a little change in its photoconductive property to stabilize the image quality even if the film thickness changes due to a long-term use and, therefore, is suitably applied to a system with a long life. In the case of using a positively charged organic photoconductor in a system with a long life, it is particularly important to set the thickness of a photoconductive layer to 25 μm or larger to increase an added amount of an electric charge generating material in order to set a residual potential to 100 V or less. Particularly, an OPC having a single layer structure is advantageous since the electric charge generating material is added in the photoconductive layer and, hence, sensitivity changes a little even if the thickness of the photoconductive layer decreases.

If the circumferential speed of the photoconductive member 3 is 180 mm/sec or faster, process times for the charging, exposure, development and charge neutralization of the photoconductive member 3 become shorter to increase a printing speed of the image forming apparatus 20. On the other hand, by increasing the circumferential speed, an application time of a development electric field acting on the toner 5 in the thin toner layer 6 on the developing roller 2 is shortened, wherefore developability needs to be increased. To this end, it is important either to reduce the adherence of the toner 5 to the developing roller 2 or to intensify the development electric field or prolong the application time of the development electric field. These measures are described later.

It is important to specify a particle size distribution of the toner 5 in order to avoid selective developability. Generally, the span of the particle size distribution of the toner 5 is measured by a Multicizer III (manufactured by Beckman Coulter, Inc.) with an aperture diameter of 100 μm (measurement range of 2.0 to 60 μm). The span of the particle size distribution is expressed by a ratio of a volume average particle diameter to a number average particle diameter. In order to prevent selective developability, it is important to make this ratio smaller. If the distribution is wide, toner particles having relatively small particles sizes accumulate on the developing roller at the time of continuous printing to decrease developability.

For better image quality, it is generally well-known to make the toner volume average particle diameter smaller. If the toner volume average particle diameter is made smaller, adherence to the developing roller 2 increases since the influence of Van der Waals' forces becomes larger. Thus, it is known that adherence to the developing roller 2 increases and the separation of the toner 5 from the carrier 4 or the release of the toner from the surface of the developing roller 2 becomes more difficult. Accordingly, the volume average particle diameter Dt of the toner 5 is preferably set within a range of 4 μm≦Dt≦7 μm. Unless Dt reaches the lower limit of this range, the adherence is too strong, which is not preferable in terms of developability and collectability of the toner from the developing roller. On the contrary, if Dt exceeds the upper limit of this range, it is difficult to obtain one-dot reproducibility and to accomplish a high image quality.

A CV value in the number particle size distribution of the toner 5 may be specified to be 25% or lower. If the CV value exceeds this range, the span of the particle diameter distribution increases to make the selective developability significant, which is not preferable. The CV value in the number particle size distribution is more preferably 22% or lower.

A magnetite carrier, Mn ferrite carrier, Mn—Mg ferrite carrier, Cu—Zn carrier or a resin carrier having a magnetic material dispersed in a resin can be used as the carrier 4, and surface processing can be applied to such an extent as not to increase a proper resistance value. The carrier 4 functions to collect the residual toner on the developing roller 2 after the development and to supply the toner thereafter. If the volume resistivity of the carrier 4 lies within a range of $10^6$ Ωcm to $10^{14}$ Ωcm, it is possible to scrape off the toner firmly electrostatically adhering to the developing roller 2 by a nip between the developing roller 2 and the magnetic roller 1 by the magnetic brush 10 and to supply the toner 5 necessary for the development.

By making the thin toner layer 6 on the developing roller 2 thinner and denser by reducing the weight average particle diameter of the carrier 4 to increase the density of the magnetic brush 10, the image quality can be improved. However, since the holding force of the carrier 4 weakens if the weight average particle diameter of the carrier 4 is reduced, the carrier scattering occurs if the bias between the developing roller 2 and the magnetic roller 1 is increased. Accordingly, the weight average particle diameter Dc of the carrier 4 may be specified within a range of 25 μm≦Dc≦45 μm. At the time of using the toner 5 having a smaller particle diameter, the thin toner layer 6 on the developing roller 2 can be densely formed to obtain an even higher image quality since the weight average particle diameter Dc of the carrier 4 is equal to or below 45 μm. On the other hand, if the weight average particle diameter Dc is below 25 μm, the carrier scattering is more likely to occur, which is not preferable.

The developing roller 2 carries the thin toner layer 6 of the toner 5 supplied from the magnetic brush 10 and develops the electrostatic latent image on the photoconductive member 3 by causing the toner 5 to fly from the thin toner layer 6. The developing roller 2 may have an outer circumferential portion thereof made of a sleeve whose base body is made of electrically conductive aluminum and which has a high resistance treatment layer on the outer surface. Besides, a SUS sleeve or a sleeve in which a base body is covered by an electrically conductive resin may be used.

The treatment layer of the sleeve is formed by cleaning the surface of the sleeve with an acid (sulfuric acid) after anodizing it in an acid aqueous solution and sealing it with a nickel acetate solution and, thereafter, applying a surface processing thereto using fluorine fine particles and/or fluorine containing fine particles. By forming this treatment layer, the toner adherence to the developing roller 2 can be reduced, wherefore the toner 5 can more easily fly from the developing roller 2 to improve the developability and the releasability (collectability) of the toner from the developing roller 2 to the magnetic roller 1. The first power supply 7 is connected to a shaft of the developing roller 2. A bias obtained by superimposing a direct current and an alternating current of the first power supply 7 acts between the rotating developing roller 2 and photoconductive member 3, thereby improving the developability of the latent image on the photoconductive member 3.

A leakage margin of the developing roller 2 can be ensured by uniformly applying a resin coating on the entire surface of the developing roller 2. It is effective to apply a fluorine resin or a urethane resin having a good toner releasability as the resin coating. If the toner 5 has a positive charge property, an image can be developed on the photoconductive member 3 with a low voltage by using a urethane resin having the same polarity. Even in the case of using a photoconductive drum having a thin amorphous silicon layer of 20 μm or less in thickness, the leakage can be suppressed to suppress problems such as black points on the photoconductive member drum.

The high resistance treatment layer present on the surface of the developing roller 2 preferably has a charge property of the same polarity as the toner 5. For example, in the case of applying a fluorine resin to the surface of the developing roller 2, electrostatic adherence is produced by having an opposite polarity if the toner 5 has the positive charge property. Accordingly, by using the material having the same polarity as the toner 5 for the high resistance treatment layer, tackiness with the toner 5 can be reduced. In this case, an intrinsic resistance value pv of the surface (treatment layer) of the developing roller 2 is preferably selected from a range of $10^5$ Ω·cm≦pv≦$10^9$ Ω·cm. By defining this range for pv, the toner 5 on the developing roller 2 can more easily fly to the photoconductive member 3 to improve the developability and the releasability (collectability) of the toner 5 from the developing roller 2 to the magnetic roller 2.

An arithmetic average roughness Ra of the surface of the developing roller 2 is preferably selected from a range of 0.4 μm≦Ra≦1.5 μm. By defining this range, the thin toner layer 6 can be densely formed on the developing roller 2 to suppress image nonuniformity and reduce the adherence of the toner 5 to the developing roller 2, wherefore an image density defect and a ghost phenomenon can be suppressed. If the arithmetic surface roughness Ra is below 0.4 μm, the thin toner layer 6 cannot be densely formed if the duty ratio is set low. Thus, there is a likelihood that image nonuniformity occurs. Conversely, if the arithmetic surface roughness Ra exceeds 1.5 μm, the adherence to the toner 5 is increased. Thus, there is a likelihood that an image density defect and a ghost phenomenon occur.

The magnetic roller 1 is formed of a nonmagnetic metallic material into a rotatable cylindrical shape and has a plurality of fixed magnets arranged inside. The magnets cause the magnetic brush 10 to be formed by the carrier 4 contained in the developer and the layer thickness of the magnetic brush 10 is restricted by the restricting blade 9. The second power supply 8 as well as the first power supply 7 is connected to a shaft of the magnetic roller 1. By permitting a bias of the first power supply 7 connected to the developing roller 2 and biases of the first and second power supplies 7, 8 connected to the magnetic roller 1 to act between the developing roller 2 and the magnetic roller 1, the thin toner layer 6 is formed on the developing roller 2 and the residual toner on the developing roller 2 is collected to the magnetic roller 1.

Thickness T of the thin toner layer 6 preferably lies in a range of 7 μm≦T≦13 μm. By keeping the thickness T of the thin toner layer 6 in this range, an amount of the residual toner on the developing roller 2 after the development of a latent image is reduced, wherefore the ghost phenomenon and the image nonuniformity can be suppressed.

In order to stabilize the image density at the time of continuous printing, the toner 5 may be regularly collected from the developing roller 2 to the magnetic roller 1 to refresh the surface of the developing roller 2. In this case, if the circumferential speed of the magnetic roller 1 is set faster than that of the developing roller 2 and equal to or slower than twice that of the developing roller 2, the residual toner (thin toner layer 6) on the developing roller 2 touches the magnetic brush 10 formed on the magnetic roller 1 to be collected by a brush effect brought about by a circumferential speed difference between the magnetic roller 1 and the developing roller 2. The collected toner 5 is agitated by the agitating screw 31*a* to promote the replacement of the toner 5.

Here, since the width of the magnetic brush 10 is the width of a collection range for collecting the toner on the developing roller 2, an area where the toner 5 cannot be collected can be reliably eliminated by setting the width of the developing roller 2 shorter than that of the magnetic roller 10. By doing so, no toner 5 adheres to the sleeve of the developing roller 2 outside the area of the magnetic roller 10, thereby eliminating the toner scattering at the opposite ends of the developing roller 2.

Figure 4A:
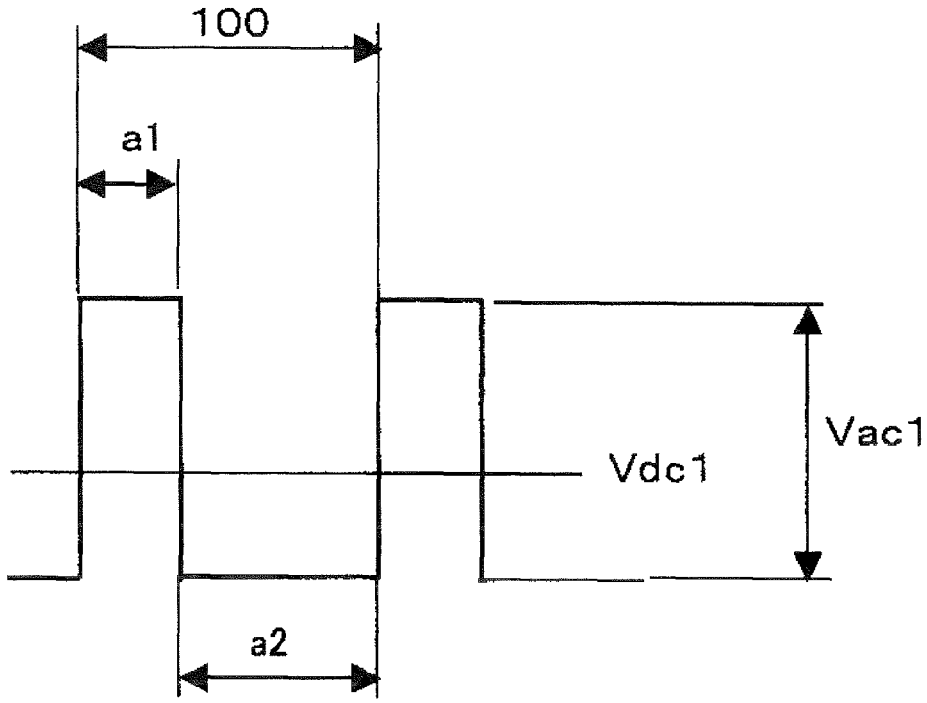
FIGS. 4A and 4B are charts showing the waveforms of biases applied from a power supply to a developing roller and a magnetic roller of the developing device.
Figure 4B:
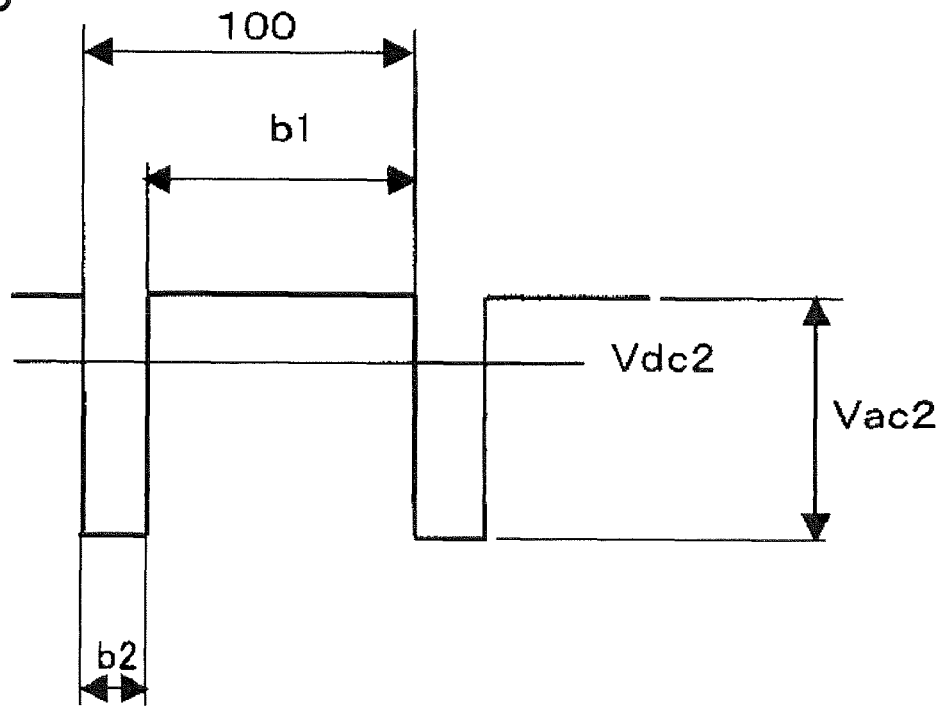

Next, the biases to be applied to the developing roller 2 and the magnetic roller 1 are described with reference to FIGS. 3, 4A and 4B. In this embodiment, the first and second power supplies 7, 8 are provided as bias applying devices. FIG. 4A shows the waveform of the bias applied from the first power supply 7 and FIG. 4B shows the waveform of the bias applied from the second power supply 8.

The first power supply 7 includes a direct-current power supply 7*a* and an alternating-current power supply 7*b*. Vdc1 is a voltage of the direct-current power supply 7*a*. The bias of the alternating-current power supply 7*b* is a rectangular wave having a voltage Vac1 as shown in FIG. 4A and a duty ratio=(a1/(a1+a2))×100. It should be noted that "a1" is a "positive" period of this rectangular wave, i.e. a period during which a voltage in a direction to transfer the toner 5 from the thin toner layer 6 of the developing roller 2 to the photoconductive member 3 is applied.

The second power supply 8 includes a direct-current power supply 8*a* and an alternating-current power supply 8*b*. Vdc2 is a voltage of the direct-current power supply 8*a*. The bias of the alternating-current power supply 8*b* is a rectangular wave having a voltage Vac2 as shown in FIG. 4B and a duty ratio=(b1/(b1+b2))×100. It should be noted that "b1" is a "positive" period of this rectangular wave, i.e. a period during which a voltage in a direction to transfer the toner 5 from the magnetic roller 1 to the developing roller 2 is applied. The bias of the alternating-current power supply 8*b* has the same frequency as and a phase opposite to the alternating-current power supply 7*b* of the first power supply 7 and has a duty ratio larger than that of the alternating-current power supply 7*b*.

Figure 5A:
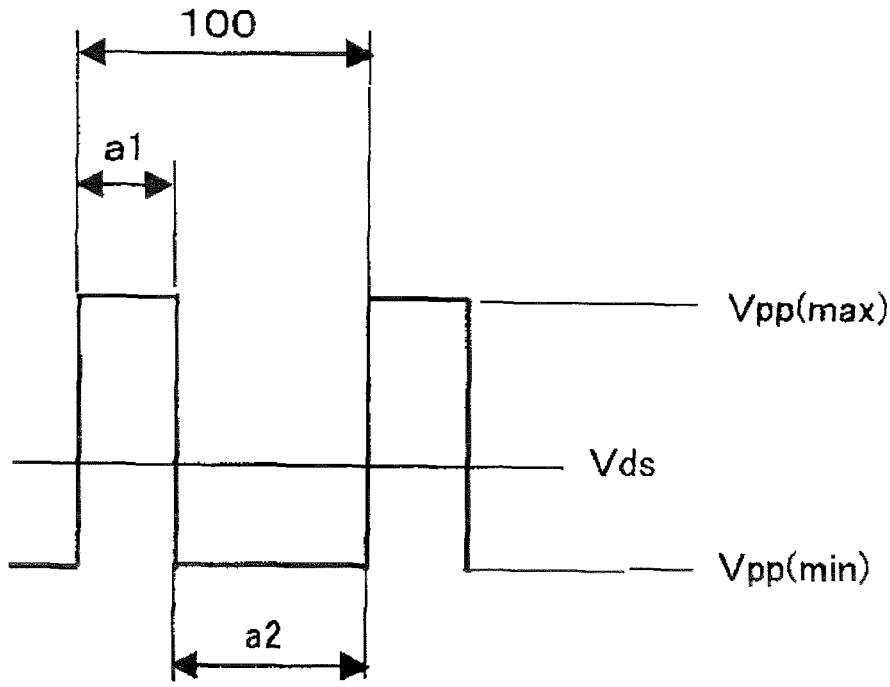
FIGS. 5A and 5B are charts showing the waveforms of an alternating-current bias and a direct-current bias to be respectively applied to the developing roller of the developing device and the photoconductive member and to the developing roller and the magnetic roller.
Figure 5B:
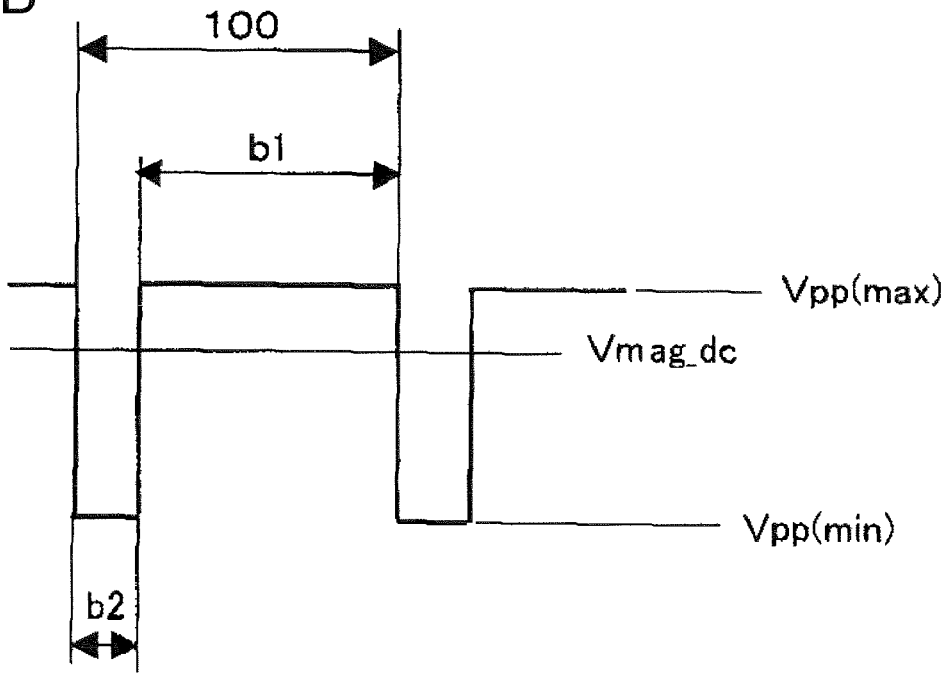

A bias in which the bias of the direct-current power supply 7*a* of the first power supply 7 and that of the alternating-current power supply 7*b* are superimposed is applied to the developing roller 2. A bias in which the bias of the first power supply 7 and those of the direct-current power supply 8*a* and the alternating-current power supply 8*b* of the second power supply 8 are superimposed is applied to the magnetic roller 1. Thus, electric fields generated by first and second biases shown in FIGS. 5A, 5B are generated between the developing roller 2 and the photoconductive member 3 and between the developing roller 2 and the magnetic roller 1. FIG. 5A shows the first bias given between the developing roller 2 and the photoconductive member 3 and FIG. 5B shows the second bias given between the developing roller 2 and the magnetic roller 1.

In the first bias shown in FIG. 5A, voltage Vds of a first direct-current bias is the voltage Vdc1 of the direct-current power supply 7*a* of the first power supply 7 and voltage Vpp of a first alternating-current bias is the voltage Vac1 of the alternating-current power supply 7*b* of the first power supply 7. A duty ratio D1 of the first bias is given by D1=(a1/(a1+a2))×100 and equal to the duty ratio of the bias of the alternating-current power supply 7*b*.

The second bias shown in FIG. 5B is a difference between the bias applied to the developing roller 2 and the one applied to the magnetic roller 1. In other words, voltage Vmag_dc of a second direct-current bias is the voltage Vdc2 of the direct-current power supply 8*a* of the second power supply 8 and voltage Vpp of a second alternating-current bias is the voltage Vac2 of the alternating-current power supply 8*b* of the second power supply 8. A duty ratio D2 of the second bias is given by D2=(b1/(b1+b2))'100 and equal to the duty ratio of the bias of the alternating-current power supply 8*b*. The duty ratios D1, D2 of the first and second alternating-current biases satisfy a relationship of the following equation:

$$D1>100-D2.$$

Next, the operation of the developing device 11*a* (developing devices 11*b* to 11*d*) of this embodiment is described with reference to FIGS. 3, 5A and 5B. The magnetic brush 10 is formed on the magnetic roller 1 by the developer containing the charged toner 5 and the carrier 4. This magnetic brush 10 has the layer thickness thereof restricted by the restricting blade 9. The second direct-current bias Vmag_dc and the second alternating-current bias Vpp shown in FIG. 5B and having the duty ratio of (b1/(b1+b2))×100 are applied to the magnetic roller 1, whereby the thin toner layer 6 only made up of the toner 5 is formed on the developing roller 2.

Subsequently, a latent image formed on the photoconductive member 3 by an exposure process is developed with the toner 5 flown to the photoconductive member 3 by applying the first direct-current bias Vds and the second alternating-current bias Vpp shown in FIG. 5A and having the duty ratio of (a1/(a1+a2))×100, whereby a toner image is formed on the photoconductive member 3. At this time, if the first alternating-current bias is applied immediately before the development process, the scattering of the toner 5 from the opposite ends of the developing roller 2 can be prevented. Thereafter, the toner images of the photoconductive members 3 are primarily transferred to the intermediate transfer belt and secondarily transferred to a sheet conveyed to the intermediate transfer belt, and the resulting toner image is fixed by the fixing device and discharged.

Thereafter, the residual toner on the developing roller 2 after the development process is released to be collected to the magnetic roller 1 by applying the second direct-current bias Vmag_dc and the second alternating-current bias Vpp shown in FIG. 5B and having the duty ratio of (b1/(b1+b2))×100.

The bias of the first power supply 7 is applied to the developing roller 2, and the superimposed bias of the bias of the first power supply 7 and that of the second power supply 8 is applied to the magnetic roller 1. Thus, the waveform of a composite bias formed between the developing roller 2 and the magnetic roller 1 becomes equal to that of the bias of the second power supply 8 and is not influenced by the bias of the first power supply 7 applied to the developing roller 2. The first bias formed between the developing roller 2 and the photoconductive member 3 is not influenced by the bias of the second power supply 8, either.

Accordingly, a control can be executed only by the bias of the first power supply 7, and the voltages and duty ratios of the first and second biases can be independently set. Thus, the developability can be improved by setting a large bias voltage between the developing roller 2 and the photoconductive member 3 and a large duty ratio D1 and, on the other hand, the bias voltage and the duty ratio between the developing roller 2 and the magnetic roller 1 can be set such that the thin toner layer 6 is satisfactorily formed on the developing roller 2 and the toner 5 is satisfactorily collected from the developing roller 2. Therefore, the biases between the developing roller 2 and the photoconductive member 3 and between the developing roller 2 and the magnetic roller 1 can be easily balanced.

By setting the duty ratio D1 of the first alternating-current bias between the developing roller 2 and the photoconductive member 3 in a range of 35%≦D1≦75%, preferably 40%≦D1≦60%, sufficient time can be obtained to generate a development electric field in a period during which developing is executed, thereby improving the developability. If the duty ratio D1 is below 35%, the developability is insufficient, making it difficult to obtain a sufficient image density and leading to a likelihood of the image nonuniformity if the circumferential speed of the photoconductive member 3 is 180 mm/sec or faster and the volume average particle diameter of the toner is 7.0 μm or smaller. Conversely, if the duty ratio D1 exceeds 75%, the toner 5 also adheres to a non-exposed part (blank part) of the electrostatic latent image on the photoconductive member 3, thereby leading to a likelihood of an image fog.

If the developability is improved by specifying the duty ratio D1 as above, a fine toner can be used and an even higher image quality can be accomplished. Since an amount of the toner to be released from the developing roller 2 is reduced and the toner adherence to the developing roller 2 is reduced, an electrical releasing force can also be reduced. Further, even if a fine carrier 4 having a small saturation magnetization is used, the carrier can be released without being scattered. Furthermore, the thin toner layer 6 on the developing roller 2 becomes uniform by using the fine toner and the fine carrier, wherefore an image of an even higher quality can be obtained and the image nonuniformity can be suppressed.

The frequency of the first alternating-current bias and that of the second alternating-current bias may be equal or may be different. Here, if a relationship between a frequency f1 of the first alternating-current bias and a frequency f2 of the second alternating-current bias is f2>f1, the thin toner layer 6 can be stably formed on the developing roller 2 and the carrier attraction can be suppressed. If the frequency relationship does not satisfy f2>f1, the thin toner layer 6 on the developing roller 2 tends to be decreased.

Various evaluation results of the image forming apparatus according to the embodiment described above are shown below.

<Evaluation 1>

Image performances were evaluated by changing the duty ratio D1 and the frequency f1 of the first bias between the developing roller 2 and the photoconductive member 3 with test conditions set as below.

An amorphous silicon drum was used as the photoconductive member 3 having an outer diameter of 30 mm; the outer diameter of the developing roller 2 was 20 mm and that of the magnetic roller 1 was 25 mm; and the circumferential speed of the photoconductive member 3 was 300 mm/sec, that of the developing roller 2 was 450 mm/sec and that of the magnetic roller 1 was 675 mm/sec. A gap between the developing roller 2 and the magnetic roller 1 was 350 μm, the voltage Vpp of the second alternating-current bias was 1.8 kV, the frequency f2 thereof was 4 kHz and the duty ratio D2 thereof was 70%, and the direct-current bias Vmag_dc thereof was changed from 100 to 300 V between the developing roller 2 and the magnetic roller 1. A dark potential of the photoconductive member 3 was set at 350 V and a bright potential thereof was set at 20 V.

Performances on the image density and the image nonuniformity were evaluated by changing the duty ratio D1 of the first alternating-current bias to 30%, 40% and 50% between the developing roller 2 and the photoconductive member 3. In the case of changing the duty ratio D1, a maximum alternating-current bias Vpp(max) and a minimum alternating-current bias Vpp(min) of the first alternating-current bias may be kept. However, if the duty ratio D1 of the first alternating-current bias is increased, there are cases where an application time of Vpp(min) becomes shorter to worsen the image fog in a non-image part. Thus, as the duty ratio D1 is changed to keep the image fog of the non-image part constant, the minimum alternating-current bias Vpp(min) may be changed while the maximum alternating-current bias Vpp(max) is kept constant.

Figure 6:
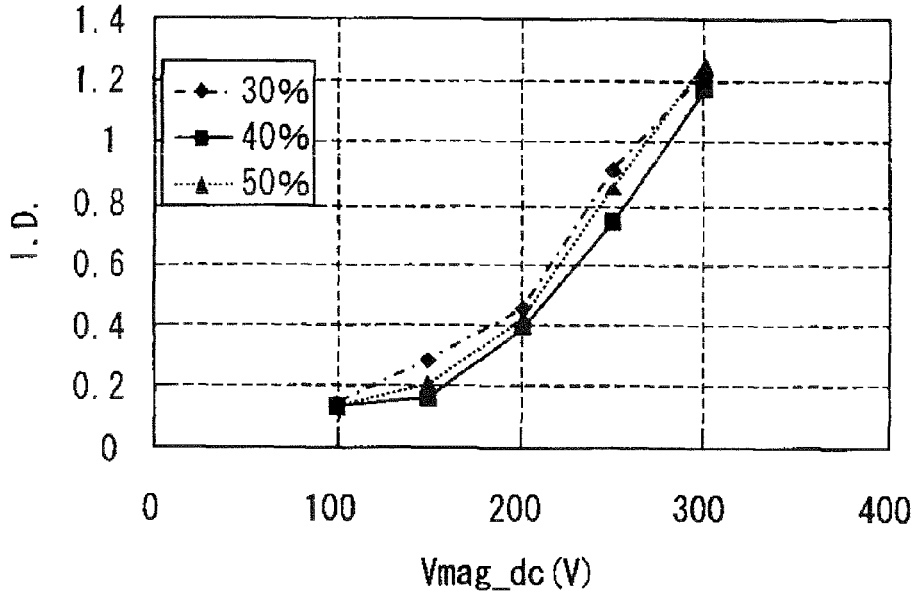
FIG. 6 is a graph showing image density in relation to a duty ratio of the developing device.
Figure 7:
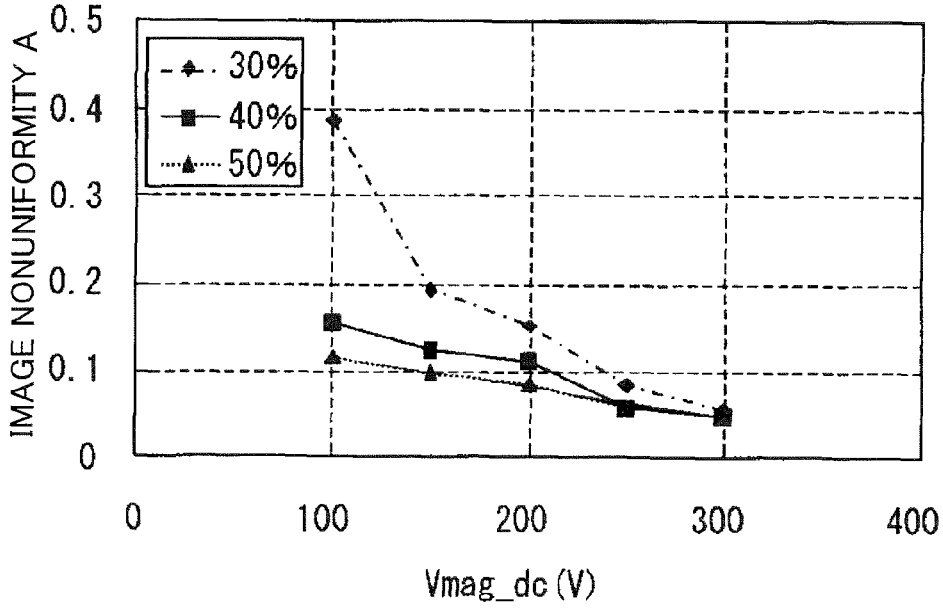
FIG. 7 is a graph showing image nonuniformity in relation to the duty ratio of the developing device.

A change of the image density resulting from a change of the duty ratio D1 is shown in FIG. 6, and a change of the image nonuniformity resulting from the change of the duty ratio D1 is shown in FIG. 7. In FIG. 6, a horizontal axis represents the direct-current bias Vmag_dc and a vertical axis represents the image density I.D. of a solid image having a tone value (600 dpi) of 100%. The image density I.D. indicates a reflection density obtained by measuring a solid image by a portable reflection densitometer RD-19 (manufactured by Sakata Inc Corporation). In FIG. 7, a horizontal axis represents the direct-current bias Vmag_dc and a vertical axis represents the image nonuniformity in a halftone image having a tone value (600 dpi) of 25%. Image nonuniformity A was calculated by $A=\sigma_D/Da$. A calculation method was such that the halftone image having a tone value (600 dpi) of 25% was scanned at 3000 dpi using a color scanner ES8500 (manufactured by Seiko Epson Corporation) and luminance was measured using a Dot Analyzer DA-6000 (manufactured by Oji Scientific Instruments).

The measured luminance Pi was converted into an image density Di by the following equation (1); an average value Da of the image density on the image was calculated by the following equation (2); deviations $\sigma_D$ from the average value of the image density were calculated by the following equation (3); and evaluation was made using $A=\sigma_D/Da$ as an image nonuniformity evaluation index. It should be noted that Pmax denotes the luminance of the solid image and Pmin denotes the luminance of a blank sheet.

$$Di = \mathrm{Log}[(P\max - Pi)/P\min] \tag{1}$$

$$Da = \frac{1}{N}\sum_{i=1}^{N} Di \tag{2}$$

$$\sigma_D = \sqrt{\frac{1}{N}\sum_{i=1}^{N}(Di - Da)^2} \tag{3}$$

A result shown in FIG. 6 indicates that the thin toner layer on the developing roller 2 becomes thicker if the direct-current bias Vmag_dc is increased, but the image density I.D is substantially constant regardless of the toner layer thickness by changing the duty ratio D1 to 30%, 40% and 50% even if the toner layer is thin. A result shown in FIG. 7 indicates that the image nonuniformity is improved if the duty ratio D1 is increased and is remarkably improved regardless of the value of the direct-current bias Vmag_dc when the duty ratio D1 is 40% and 50%.

The image nonuniformity can be reduced by thickening the thin toner layer formed on the developing roller 2 by increasing Vmag_dc as by the conventional method but, at the same time, it becomes difficult to collect the toner on the developing roller 2 by the magnetic roller 1 since the thin toner layer is thickened. On the contrary, the result of FIG. 7 indicates that the image nonuniformity can be reduced even if Vmag_dc is decreased and the thin toner layer is made thinner and reveals together with the result shown in FIG. 6 that the image density I.D can be maintained.

Further, according to the conventional method, the toner collectability to the magnetic roller 1 is reduced if the duty ratio D1 is increased. However, since the duty ratio D1 does not influence the toner collectability to the magnetic roller 1 according to this embodiment, an image density defect caused by the ghost phenomenon or an increase in the toner charge can also be reduced. In other words, it is indicated that the image nonuniformity can be suppressed while the image density I.D is maintained by increasing the duty ratio D1 of the first alternating-current bias and that the image density defect caused by the ghost phenomenon or an increase in the toner charge can also be reduced by setting the duty ratio D1 of the first alternating-current bias to 40% and 50% relative to the duty ratio D2 of 70% of the second alternating-current bias, i.e. by satisfying the relationship D1>100−D2.

<Evaluation 2>

Figure 8:
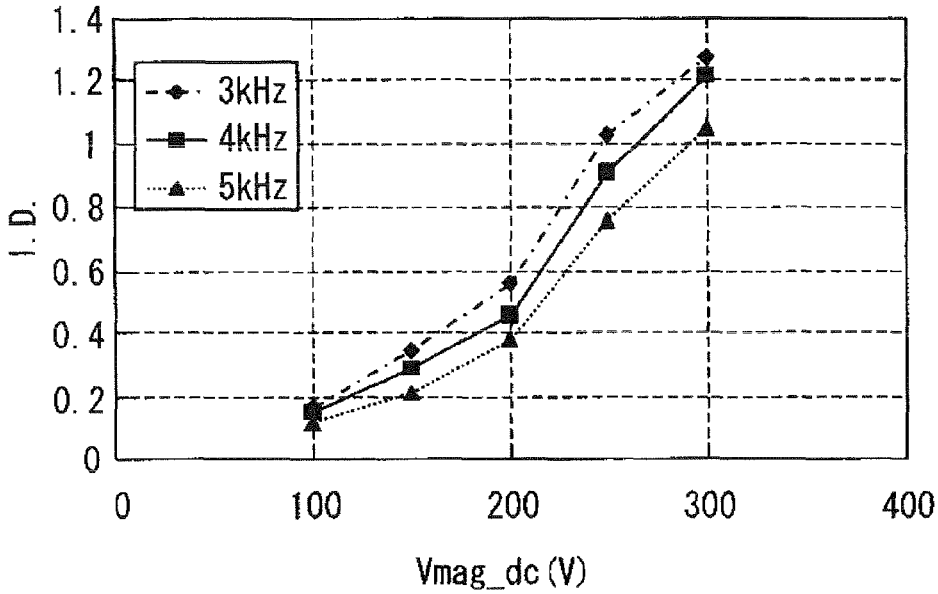
FIG. 8 is a graph showing image density in relation to the frequency of the alternating-current bias.
Figure 9:
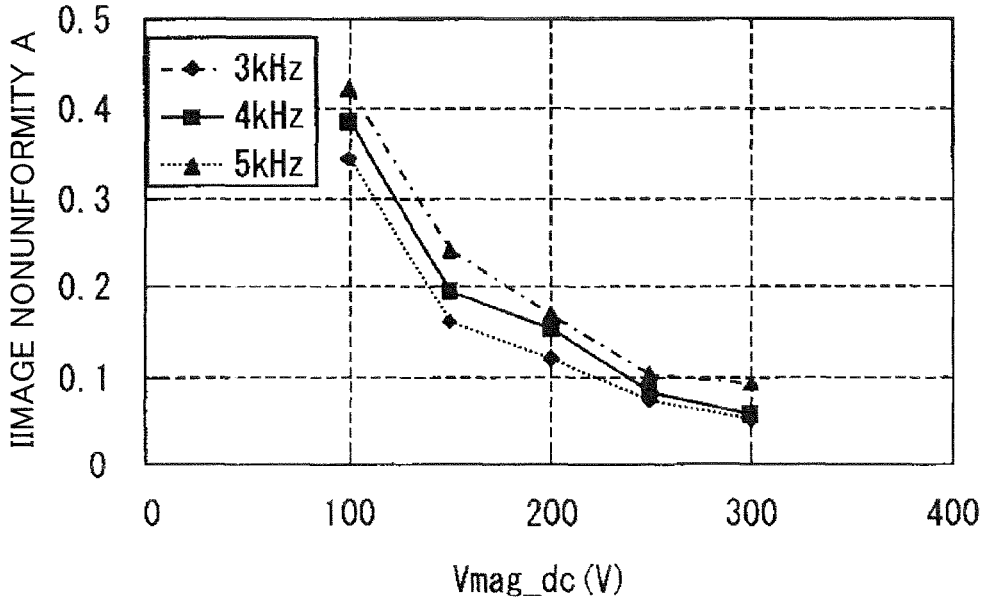
FIG. 9 is a graph showing image nonuniformity in relation to the frequency of the alternating-current bias.

Performances on the image density and the image nonuniformity were evaluated by changing the frequency f1 of the first alternating-current bias to 3 kHz, 4 kHz and 5 kHz between the developing roller 2 and the photoconductive member 3. Test conditions were the same as in the above evaluation resulting from the change of the duty ratio D1. FIG. 8 shows a change in the image density resulting from a change of the frequency f1 in the first alternating-current bias, and FIG. 9 shows a change of the image nonuniformity resulting from the change of the frequency f1. Coordinate axes of graphs are the same as in FIGS. 6 and 7.

A result of FIG. 8 indicates that the image density I.D increases with the respective biases Vmag_dc if the frequency f1 is decreased to 5 kHz, 4 kHz and 3 kHz. A result of FIG. 9 indicates that the image nonuniformity is improved with the respective biases Vmag_dc if the frequency f1 is decreased to 5 kHz, 4 kHz and 3 kHz.

<Evaluation 3>

Carrier attraction was evaluated by changing the frequency f2 of the second alternating-current bias to 3 kHz, 4 kHz and 5 kHz between the developing roller 2 and the magnetic roller 1. Test conditions were such that the voltage Vpp of the first alternating-current bias was 1.6 kV, the frequency f1 thereof was 3 kHz, the duty ratio D1 thereof was 40% and the direct bias Vmag_dc was changed from 350 to 500 V. Other test conditions were the same as in the evaluation resulting from the above change of the duty ratio D1.

An evaluation result is shown in table-1. The carrier attraction was evaluated by collecting the carrier residual on the developing roller 2 when the thin toner layer 6 was formed on the developing roller 2 and measuring the weight of the collected carrier. ○ represents that the carrier 4 residual on the developing roller 2 was below 30 mg, Δ represents that the residual carrier 4 was from 30 mg (inclusive) to 50 mg (exclusive), and x represents that the residual carrier 4 was 50 mg or more.

TABLE 1

| | f2 | | |
|---|---|---|---|
| Vmag_dc | 3 kHz | 4 kHz | 5 kHz |
| 350 | ○ | ○ | ○ |
| 400 | Δ | ○ | ○ |
| 450 | X | Δ | ○ |
| 500 | X | X | ○ |

From the result shown in table 1, it can be understood that less carrier attraction is seen if the direct-current bias Vmag_dc is decreased or if the frequency f2 is increased. Particularly, it can be understood that, if the direct-current bias Vmag_dc is from 350 V to 400 V, less carrier attraction is seen when the frequency f2 is 4 kHz and 5 kHz, i.e. higher than the frequency f1 of the first alternating-current bias.

<Evaluation 4>

In the next evaluation, imaging performances were evaluated for ten modes (Examples 1 to 8, Comparative Examples 1 and 2) in which the duty ratio D1, the duty ratio D2 and the thickness of the thin toner layer 6 were changed as shown in table-2. Test conditions were such that an amorphous silicon drum was used as the photoconductive member 3; the outer diameter of the photoconductive member 3 was 30 mm, that of the developing roller 2 was 20 mm and that of the magnetic roller 1 was 25 mm; the circumferential speed of the photoconductive member 3 was 300 mm/sec, that of the developing roller 2 was 450 mm/sec and that of the magnetic roller 1 was 675 mm/sec; and a gap between the developing roller 2 and the magnetic roller 1 was 350 μm.

In Example 1, the first bias between the developing roller 2 and the photoconductive member 3 was such that the voltage Vds of the first direct-current bias was 300 V, the voltage Vpp of the first alternating-current bias was 1.6 kV, the frequency f1 thereof was 2.7 kHz and the duty ratio D1 thereof was 35%. The second bias between the developing roller 2 and the magnetic roller 1 was such that the second direct-current bias Vmag_dc was 400 V, the voltage Vpp of the second alternating-current bias having the same frequency as and a phase opposite to the first alternating-current bias was 2.8 kV, the frequency f2 thereof was 2.7 kHz and the duty ratio D2 thereof was 70%. The toner 5 had a volume average particle diameter of 6.5 μm and a CV value of 25% or lower in a number distribution, and the carrier 4 having a weight average particle diameter of 45 μm and a saturation magnetization of 65 emu/g was used. It should be noted that the thickness of the thin toner layer 6 was calculated by measuring the diameter of the developing roller formed with the thin toner layer 6 and that of the developing roller formed with no thin toner layer 6 using a LASER SCAN DIAMETER LS-3100 (manufactured by Keyence Corporation).

In Examples 2 to 6 and Comparative Examples 1 and 2, biases were applied with the duty ratio D1 changed by suitably changing Vpp and Vdc such that Vpp(max) is equal to that in Example 1 and with the duty ratio D2 changed by suitably changing Vpp and Vdc such that Vpp(min) is equal to that in Example 1. In Examples 7 and 8, the voltages Vpp (max) of the duty ratios D2 in Examples 3, 1 were suitably changed to adjust the toner layer thickness.

The evaluation result on the imaging performances resulting from a change of the thin toner layer thickness is shown in table-2. In an image density ID of table-2, ○ represents the image density ID of 1.30 or above, A represents that of from 1.28 (inclusive) to 1.30 (exclusive) and x represents that of below 1.28. In image nonuniformity of table-2, ◎ represents an image nonuniformity evaluation coefficient of below 0.13, ○ represents that of from 0.13 (inclusive) to 0.15 (exclusive), Δ represents that of from 0.15 (inclusive) to 0.165 (exclusive) and x represents that of above 0.165. The ghost phenomenon was evaluated by outputting a ghost phenomenon evaluation image from a testing apparatus and examining the outputted image by the eyes. ○ represents no appearance of the ghost phenomenon, Δ represents a slight appearance of the ghost phenomenon, and x represents a clear appearance of the ghost phenomenon. The image fog was evaluated by measuring solid parts and blank parts of the outputted images on the respective developing conditions using a portable reflection densitometer RD-19 (manufactured by Sakata Inc Corporation), wherein ○ represents a reflection density of 0.005 or below and x represents that of above 0.005.

TABLE 2

| | Duty Ratio | Duty Ratio | Toner Layer Thickness [μm] | Image Density ID | Image Non-uniformity A | Ghost Phenomenon | Image Fog FD |
|---|---|---|---|---|---|---|---|
| Example 1 | 35 | 70 | 13 | ○ 1.341 | ○ 0.141 | ○ | ○ 0.001 |
| Example 2 | 55 | 50 | 10.35 | ○ 1.358 | ◎ 0.122 | ○ | ○ 0.001 |
| Example 3 | 70 | 35 | 7.05 | ○ 1.335 | ◎ 0.127 | Δ | ○ 0.004 |
| Example 4 | 45 | 65 | 12.15 | ○ 1.351 | ◎ 0.129 | ○ | ○ 0.002 |
| Example 5 | 55 | 60 | 11.85 | ○ 1.401 | ◎ 0.114 | ○ | ○ 0.001 |
| Example 6 | 60 | 60 | 11.87 | ○ 1.402 | ◎ 0.112 | ○ | ○ 0.002 |
| Example 7 | 70 | 35 | 6.95 | Δ 1.295 | ◎ 0.129 | Δ | ○ 0.004 |
| Example 8 | 35 | 70 | 13.12 | ○ 1.338 | Δ 0.155 | ○ | ○ 0.001 |
| Com. Exa. 1 | 30 | 70 | 13.25 | ○ 1.346 | X 0.252 | Δ | ○ 0.001 |
| Com. Exa. 2 | 50 | 50 | 10.35 | ○ 1.351 | Δ 0.161 | X | ○ 0.001 |

As shown in table-2, image nonuniformity was seen in Comparative Example 1; large image nonuniformity was seen and a slight ghost phenomenon was seen in Comparative Example 2. However, in the Examples 1 to 8, imaging performances were satisfactory in all of the image density, the image nonuniformity, the ghost phenomenon and the image fog.

INDUSTRIAL APPLICABILITY

The present invention is applicable to image forming apparatuses such as copiers, printers and facsimile machines and particularly applicable to image forming apparatuses including a developing device using a two-component developer containing a magnetic carrier and a nonmagnetic toner.

The present invention is not limited to the above embodiments and embraces the following contents.

An image forming apparatus according to one aspect of the present invention comprises a photoconductive member on which a latent image is to be formed; a developing roller for developing the latent image formed on the photoconductive member by a first bias; a magnetic roller for forming a magnetic brush thereon with a two-component developer containing a carrier and a toner and forming a thin toner layer on the developing roller by a second bias; and a bias applying device for applying biases to the developing roller and the magnetic roller, wherein the first bias includes a first alternating-current bias in the form of a rectangular wave and the second bias includes a second alternating-current bias in the form of a rectangular wave; and if D1 denotes the duty ratio of the first alternating-current bias and D2 denotes the duty ratio of the second alternating-current bias, the duty ratios D1, D2 satisfy the following relationship when the duty ratio D1 is calculated using an application period of a voltage in a direction to transfer the toner from the developing roller toward the photoconductive member as a positive period and the duty ratio D2 is calculated using an application period of a voltage in a direction to transfer the toner from the magnetic roller toward the developing roller as a positive period:

$$D1>100-D2.$$

According to this construction, the magnetic brush is formed on the magnetic roller by the two-component developer and is brought into contact with the developing roller to form the thin toner layer on the developing roller by the alternating-current bias having the duty ratio D2 and given between the magnetic roller and the developing roller. The latent image on the photoconductive member is developed with the toner flown from the thin toner layer on the developing roller to the photoconductive member by the bias having the duty ratio D1 and given between the developing roller and the photoconductive member, whereby a toner image is formed.

Here, by letting the duty ratios D1, D2 satisfy the relationship of D1>100−D2, a bias application period between the photoconductive member and the developing roller is extended to improve developability and, particularly to suppress image nonuniformity caused by the development of a low tone image. The developability, the formation of the thin toner layer and the toner collection from the developing roller can be balanced by satisfactorily forming the thin toner layer on the developing roller and collecting the toner from the developing roller regarding the developing roller and the magnetic roller.

In the above construction, if f1 denotes the frequency of the first alternating-current bias and f2 denotes the frequency of the second alternating-current bias, the frequencies f1, f2 preferably satisfy the following relationship:

$$f2>f1.$$

According to this construction, the latent image on the photoconductive member is developed with the toner flown from the thin toner layer on the developing roller to the photoconductive member by the bias of the frequency f1 given between the developing roller and the photoconductive member, whereby a toner image is formed. Then, the toner residual on the developing roller is collected by the bias of the frequency f2 given between the magnetic roller and the developing roller. By making the frequency f2 of the second alternating-current bias higher than the frequency f1 of the first alternating-current bias, the developability of the developing roller and the photoconductive member is improved, and the collection of the toner residual on the developing roller after the development and the formation of the thin toner layer by the magnetic roller become satisfactory.

In the above construction, the circumferential speed of the photoconductive member is preferably 180 mm/sec or faster. According to this construction, process times such as charging, exposure, development and charge neutralization for the photoconductive member can be shortened. Therefore, high-speed printing of the image forming apparatus is possible.

In the above construction, it is preferable that the bias applying device includes a first power supply and a second power supply for generating biases; that a bias of the first power supply is applied to the developing roller; and that a superimposed bias of the bias of the first power supply and that of the second power supply is applied to the magnetic roller.

According to this construction, a potential difference between the developing roller and the magnetic roller is equal to the voltage of the second power supply to be applied to the magnetic roller regardless of the first bias. Specifically, the first bias is set by the first power supply for applying the bias to the developing roller, the second bias is set by the second power supply for applying the bias to the magnetic roller, and the first and second biases do not influence each other. Thus, even if the duty ratios and frequencies of the respective biases are independently set to balance the developability on the photoconductive member by the first bias and the formation of the thin toner layer on the developing roller and the collection of the toner residual on the developing roller by the second bias, there is no likelihood that the bias application periods between the developing roller and the magnetic roller are shortened and the collection of the residual toner and the formation of the thin toner layer become insufficient due to the distortion of the waveforms of the rectangular waves of the respective biases.

An image forming apparatus according to another aspect of the present invention comprises a photoconductive member on which a latent image is to be formed; a developing roller for developing the latent image formed on the photoconductive member by a first bias; a magnetic roller for forming a magnetic brush thereon with a two-component developer containing a carrier and a toner and forming a thin toner layer on the developing roller by a second bias; and a bias applying device for applying biases to the developing roller and the magnetic roller, wherein the first bias includes a first alternating-current bias in the form of a rectangular wave and the second bias includes a second alternating-current bias in the form of a rectangular wave; and if f1 denotes the frequency of the first alternating-current bias and f2 denotes the frequency of the second alternating-current bias, the frequencies f1, f2 satisfy the following relationship:

$$f2>f1.$$

An image forming apparatus according to still another aspect of the present invention comprises a photoconductive member on which a latent image is to be formed; a developing roller for developing the latent image formed on the photoconductive member by a first bias; a magnetic roller for forming a magnetic brush thereon with a two-component developer containing a carrier and a toner and forming a thin toner layer on the developing roller by a second bias; and a bias applying device including a first power supply and a second power supply for generating biases and adapted to apply biases to the developing roller and the magnetic roller, wherein a bias of the first power supply is applied as the first bias to the developing roller; and a superimposed bias of the bias of the first power supply and that of the second power supply is applied as the second bias to the magnetic roller.

An image forming apparatus according to still another aspect of the present invention comprises a photoconductive member on which a latent image is to be formed; a developing roller for developing the latent image formed on the photoconductive member by a first bias; a magnetic roller for forming a magnetic brush thereon with a two-component developer containing a carrier and a toner and forming a thin toner layer on the developing roller by a second bias; and a bias applying device including a first power supply and a second power supply for generating biases and adapted to apply biases to the developing roller and the magnetic roller, wherein a bias of the first power supply is applied as the first bias to the developing roller; a superimposed bias of the bias of the first power supply and that of the second power supply is applied as the second bias to the magnetic roller; the first bias includes a first alternating-current bias in the form of a rectangular wave and the second bias includes a second alternating-current bias in the form of a rectangular wave; and if D1, f1 denotes the duty ratio and frequency of the first alternating-current bias and D2, f2 denotes the duty ratio and frequency of the second alternating-current bias, the duty ratios D1, D2 and the frequencies f1, f2 satisfy the following relationships when the duty ratio D1 is calculated using an application period of a voltage in a direction to transfer the toner from the developing roller toward the photoconductive member as a positive period and the duty ratio D2 is calculated using an application period of a voltage in a direction to transfer the toner from the magnetic roller toward the developing roller as a positive period:

$$D1>100-D2, \text{ and}$$

$$f2>f1.$$

This application is based on patent application No. 2007-072784 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An image forming apparatus, comprising:

a photoconductive member on which a latent image is to be formed;

a developing roller for developing the latent image formed on the photoconductive member by a first bias;

a magnetic roller for forming a magnetic brush thereon with a two-component developer containing a carrier and a toner and forming a thin toner layer on the developing roller by a second bias; and a bias applying device for applying biases to the developing roller and the magnetic roller, wherein:

the first bias includes a first alternating-current bias in the form of a rectangular wave and the second bias includes a second alternating-current bias in the form of a rectangular wave; and if D1 denotes the duty ratio of the first alternating-current bias and D2 denotes the duty ratio of the second alternating-current bias, the duty ratios D1, D2 satisfy the following relationship when the duty ratio D1 is calculated using an application period of a voltage in a direction to transfer the toner from the developing roller toward the photoconductive member as a positive period and the duty ratio D2 is calculated using an application period of a voltage in a direction to transfer the toner from the magnetic roller toward the developing roller as a positive period:

$$D1>100-D2.$$

2. An image forming apparatus according to claim 1, wherein, if f1 denotes the frequency of the first alternating-current bias and f2 denotes the frequency of the second alternating-current bias, the frequencies f1, f2 satisfy the following relationship:

$$f2>f1.$$

3. An image forming apparatus according to claim 1, the circumferential speed of the photoconductive member is 180 mm/sec or faster.

4. An image forming apparatus according to claim 1, wherein:

the bias applying device includes a first power supply and a second power supply for generating biases;

a bias of the first power supply is applied to the developing roller; and a superimposed bias of the bias of the first power supply and that of the second power supply is applied to the magnetic roller.

5. An image forming apparatus, comprising:

a photoconductive member on which a latent image is to be formed;

a developing roller for developing the latent image formed on the photoconductive member by a first bias;

a magnetic roller for forming a magnetic brush thereon with a two-component developer containing a carrier and a toner and forming a thin toner layer on the developing roller by a second bias; and a bias applying device for applying biases to the developing roller and the magnetic roller, wherein:

the first bias includes a first alternating-current bias in the form of a rectangular wave and the second bias includes a second alternating-current bias in the form of a rectangular wave; and if f1 denotes the frequency of the first alternating-current bias and f2 denotes the frequency of the second alternating-current bias, the frequencies f1, f2 satisfy the following relationship:

$$f2>f1.$$

6. An image forming apparatus according to claim 5, wherein:

if D1 denotes the duty ratio of the first alternating-current bias and D2 denotes the duty ratio of the second alternating-current bias, the duty ratios D1, D2 satisfy the following relationship when the duty ratio D1 is calculated using an application period in a direction to transfer the toner from the developing roller to the photoconductive member as a positive period and the duty ratio D2 is calculated using an application period in a direction to transfer the toner from the magnetic roller to the developing roller as a positive period:

$$D1>100-D2.$$

7. An image forming apparatus according to claim 5, the circumferential speed of the photoconductive member is 180 mm/sec or faster.

8. An image forming apparatus according to claim 5, wherein:

the bias applying device includes a first power supply and a second power supply for generating biases;

a bias of the first power supply is applied to the developing roller; and a superimposed bias of the bias of the first power supply and that of the second power supply is applied to the magnetic roller.

9. An image forming apparatus, comprising:

a photoconductive member on which a latent image is to be formed;

a developing roller for developing the latent image formed on the photoconductive member by a first bias;

a magnetic roller for forming a magnetic brush thereon with a two-component developer containing a carrier and a toner and forming a thin toner layer on the developing roller by a second bias; and a bias applying device including a first power supply and a second power supply for generating biases and adapted to apply biases to the developing roller and the magnetic roller, wherein:

a bias of the first power supply is applied as the first bias to the developing roller; and a superimposed bias of the bias of the first power supply and that of the second power supply is applied as the second bias to the magnetic roller.

10. An image forming apparatus according to claim 9, wherein:

the first bias includes a first alternating-current bias in the form of a rectangular wave and the second bias includes a second alternating-current bias in the form of a rectangular wave; and if D1 denotes the duty ratio of the first alternating-current bias and D2 denotes the duty ratio of the second alternating-current bias, the duty ratios D1, D2 satisfy the following relationship when the duty ratio D1 is calculated using an application period in a direction to transfer the toner from the developing roller to the photoconductive member as a positive period and the duty ratio D2 is calculated using an application period in a direction to transfer the toner from the magnetic roller to the developing roller as a positive period:

$$D1>100-D2.$$

11. An image forming apparatus according to claim 9, wherein, if f1 denotes the frequency of the first alternating-current bias and f2 denotes the frequency of the second alternating-current bias, the frequencies f1, f2 satisfy the following relationship:

$$f2>f1.$$

12. An image forming apparatus according to claim 9, the circumferential speed of the photoconductive member is 180 mm/sec or faster.

13. An image forming apparatus, comprising:

a photoconductive member on which a latent image is to be formed;

a developing roller for developing the latent image formed on the photoconductive member by a first bias;

a magnetic roller for forming a magnetic brush thereon with a two-component developer containing a carrier and a toner and forming a thin toner layer on the developing roller by a second bias; and a bias applying device including a first power supply and a second power supply for generating biases and adapted to apply biases to the developing roller and the magnetic roller, wherein:

a bias of the first power supply is applied as the first bias to the developing roller;

a superimposed bias of the bias of the first power supply and that of the second power supply is applied as the second bias to the magnetic roller;

the first bias includes a first alternating-current bias in the form of a rectangular wave and the second bias includes a second alternating-current bias in the form of a rectangular wave; and if D1, f1 denotes the duty ratio and frequency of the first alternating-current bias and D2, f2 denotes the duty ratio and frequency of the second alternating-current bias, the duty ratios D1, D2 and the frequencies f1, f2 satisfy the following relationships when the duty ratio D1 is calculated using an application period of a voltage in a direction to transfer the toner from the developing roller toward the photoconductive member as a positive period and the duty ratio D2 is calculated using an application period of a voltage in a direction to transfer the toner from the magnetic roller toward the developing roller as a positive period:

$$D1>100-D2, \text{ and}$$

$$f2>f1.$$

14. An image forming apparatus according to claim 13, the circumferential speed of the photoconductive member is 180 mm/sec or faster.

* * * * *